US005810217A

United States Patent [19]

Ohsugi

[11] Patent Number: 5,810,217

[45] Date of Patent: Sep. 22, 1998

[54] CLOTHESPIN AND CLOTHES-EQUIPMENT

[75] Inventor: Yasuhiro Ohsugi, Hiroshima, Japan

[73] Assignee: NKG Co., Ltd., Hiroshima, Japan

[21] Appl. No.: 761,441

[22] Filed: Dec. 6, 1996

[30] Foreign Application Priority Data

| | | | |
|---|---|---|---|
| Jan. 9, 1996 | [JP] | Japan | 8-028408 |
| Jun. 6, 1996 | [JP] | Japan | 8-144502 |
| Nov. 6, 1996 | [JP] | Japan | 8-294247 |

[51] Int. Cl.[6] ..... A47G 25/14; G09F 7/00

[52] U.S. Cl. ..... 223/85; 223/DIG. 2; 223/91; 40/DIG. 22; 40/488; 40/507

[58] Field of Search ..... 223/85–90, 91, 223/93, DIG. 2; 24/DIG. 22, 488, 507

[56] References Cited

U.S. PATENT DOCUMENTS

| | | | |
|---|---|---|---|
| 126,549 | 5/1872 | Howard | 24/507 |
| 305,621 | 9/1884 | McGovern | 24/488 |
| 1,003,247 | 9/1911 | Fritchey | 24/DIG. 22 |
| 1,187,226 | 6/1916 | Anderson | 24/488 |
| 2,815,777 | 12/1957 | Iraids | 24/507 |
| 4,956,899 | 9/1990 | Green | 24/488 |

FOREIGN PATENT DOCUMENTS

| | | |
|---|---|---|
| 64-6321347 | 4/1975 | Taiwan . |

*Primary Examiner*—Bibhu Mohanty
*Attorney, Agent, or Firm*—Darby & Darby

[57] ABSTRACT

A clothespin where a rotary body which is provided with a plurality of blade portions is pivotally supported on a pinching member to pinch the pinching object with the blade portion, the pinching object can be firmly supported with the elastic force of the blade portion and the rotation of the rotary body is adapted to be effected smoothly in the taking off operation of the pinching object.

12 Claims, 24 Drawing Sheets

CLOTHESPIN AND CLOTHES-EQUIPMENT

BACKGROUND OF THE INVENTION

1. Field of the invention

The present invention relates to a clothespin for chiefly pinching washing and a clothes-equipment for using the clothespins.

2. Description of Related Art

Generally the clothespin has construction where the middle of a pair of pinching members is pivotally supported, first sides of the pinching members have a pressing portion, second sides have a holding portion, and the pressing portion is urged in a direction of mutually approaching the first sides by the elastic force of a spring. To dry the washing or the like, the pressing portion is opened by the approaching of the holding portion to fix with a portion of the washing being pinched by the pressing portion. After the drying of the washing, the pressing portion is opened again with the approaching of the holding portion to take out the washing.

Such work was repeated at each washing operation. Especially an taking-off operation of the washing dried from the clothespin was bothersome. To solve it, various types of clothespins were conventionally proposed. For example, some clothespin had a rotary body in the pressing portion. Some rotary bodies were disc or spherical, were angular or square in shape when seen from section. They were designed to allow the washing to be taken off without a finger operation of the holding portion by the rotation of the rotary body through the manual pulling of the washing fixed in the pressing portion.

FIG. 1, FIG. 2, FIG. 3 show elevational views each showing the construction of the conventional types of clothespins. As shown in each drawing, a pair of pinching members 42, 42 are pivotally supported in the middle, and are urged in a direction of approaching the pressing portion 45 by the elastic force of a spring 44. A rotary body 43 is set in the pressing portion 45 so that the washing may be pinched by the rotary bodies 43, 43. FIG. 1 shows a disc-shaped or sphere-shaped rotary body 43. FIG. 2 shows a square-shaped rotary body 43, seen in section. FIG. 3 shows an angular-shaped rotary body 43, seen in section. In the use of such clothespins, the washing is pinched and fixed between the rotary bodies 43, 43, the rotary body 43 is rotated by the pulling of the washing dried to take off the washing from the clothespin.

But the conventional type of clothespin having especially the rotary body 43 triangular or square, viewed in section, was very difficult to rotate the rotary body 43 when the washing was firmly pinched, because an interior angle of the rotary body 43 was 90° or less. The washing was required to be pulled strongly more than necessary. At this time, the washing was taken off forcibly without the rotation of the rotary body 43, thus making it impossible to effect the taking-in operation smoothly. Also, there is the problem in that the washing was damaged or the rotary boy 43 itself was damaged.

Also, when the rotary body 43 was disc or spherical in shape, the rotary body 43 was rotated because of the weight in the case of the pinching of the wet washing increased in weight, with a problem that the washing fell off from the clothespin halfway during the drying operation of the washing. There was another problem where the washing fell off from the clothespin halfway during the drying operation of the washing because of insufficient pinching force of the pressing portion when the wet washing increased in weight was pinched, because the rotary body 43 angular or square seen in section was weakened in pinching force of the pressing portion 45 to the extent that the rotation could be smoothly effected.

SUMMARY OF THE INVENTION

The present invention was devised to overcome the aforementioned problems. Accordingly, an object of the present invention is to provide a clothespin and a clothes-equipment including rotary bodies capable of reliably pinching the object to be pinched, and of easily and smoothly taking in the object to be pinched in the taking-in operation.

A clothespin according to a first invention is characterized in having a pair of pinching members which is pivotally supported in the middle, and is urged in a direction of approaching the first sides towards each other with the elastic force, a rotary body set in the first side of the pinching member to pinch the object, the rotary body having a basic body pivotally supported on the pinching member, and a plurality of blade portions projected from the peripheral face of the basic body, each having a basic portion projected from the basic body and pinching elastic pressure pieces extending in a peripheral direction having a predetermined angle with respect to the basic portion.

In the first invention, with accompanied by the rotation of two rotary bodies, the pinching elastic pressure pieces are deflected onto the side closer to the rotary body with the elastic force. As the pinching elastic pressure pieces are deformed into ail approximately circular arc, seen in section, the rotary body is rotated smoothly even in a case where strong pinching force is given to the pinching members.

A clothespin according to a second invention is characterized in that in the first invention, each blade portion is 120°±10° on the side closer to basic body in the pinching elastic pressure piece of the adjacent blade portions.

In the second invention, the adjacent pinching elastic pressure pieces form approximately 120°, when the rotary body has six blade portions, to make the angle of the pinching elastic pressure pieces obtuse so that the rotary body may be rotated smoothly.

The clothespin according to a third invention is characterized in that in the first invention, each pinching elastic pressure piece bend the tip end of the external peripheral face to the outside.

In the third invention, the tip end of the external peripheral face of the pinching elastic pressure piece for pinching the object bends to the side opposite to the rotary bodies so that the object can be firmly pinched further.

A clothespin according to a fourth invention is characterized in that in the third invention, the rotary bodies pivotally supported on the pinching members are caused to oppose against the corresponding pinching elastic pressure pieces through different rotation phase.

In the fourth invention, the rotation phase of the rotary bodies is different so that the tip ends of the pinching elastic pressure pieces press against each other out of phase. As the tip ends of the pinching elastic pressure pieces bent to the opposite side are put out of shift to pinch the object, the pinching the object can be firmly effected much further. Also, as the pinching elastic pressure pieces in the lower stage of the pinching elastic pressure piece for pinching the object support the object in a state where the tip ends are interlocked each other, the object can be firmly further pinched. (See FIG. 15.)

In a clothespin according to a fifth invention is characterized in that in either of the first invention through the fourth invention, each of the pinching elastic pressure pieces is extended beyond the extended line of the adjacent pinching elastic pressure pieces, closer to the basic portion.

In the fifth invention, in the lower stage of the pinching elastic pressure pieces, the extended tip ends of the pinching elastic pressure pieces press the object to be pinch, the object can be pinched further firmly so that the object can be prevented from coming off reluctantly. (See FIG. 15)

Also, in the present invention, as shown in FIG. 16 showing a condition where the pinching elastic pressure pieces deliver the object, the elastic pressure pieces 33$b_u$, 33$b_u$ in the upper stage pinch the washing 6 immediately before leaving the washing 6 by the rotation of the rotary bodies 3, 3. At this time, the elastic pressure pieces 33*b*, 33*b* become deformed into approximately circular arc to make the rotation smooth. Also, the elastic pressure pieces 33$b_u$, 33$b_u$ pinch the washing 6 on the side upper than the central line connecting the axial center of the rotary bodies 3, 3 to give to the rotary bodies 3, 3 force in a direction for preventing the rotation. Thereafter, when the force of pulling the washing 6 has been given to the washing 6 further, the elastic pressure pieces 33*b*, 33*b* pinch the washing 6 with the tip ends out of phase. Namely, the tip end of elastic pressure piece 33*b* of one rotary body 3 presses the interlocking space 34 of the other rotary body 3 to firmly hold the washing 6.

Pinching of the object on the side upper than the central line by the pinching elastic pressure piece in the upper stage in this manner is realized by at least one of forming of the pinching elastic pressure pieces of the second invention into an obtuse angle, bending of the tip ends of the pinching elastic pressure pieces of the third invention towards the side opposite to the rotary body, and extending of the tip ends of the pinching elastic pressure pieces of the fifth invention beyond the extension line on the side closer to the basic portion of the adjacent pinching elastic pressure piece. Also, by the different rotation phase of the rotary body of the fourth invention, the prevention of the movement in the downward direction of the object can be realized on the side lower than the central line of the rotary body. As the deformation for the rotation and the pinching of the object of the pinching elastic pressure pieces are repeated sequentially with accompanied by the rotation of the rotary body, the pinching object can be delivered in accordance with the rotation measure of the rotary body, so that the pinching object may not come off by the reluctant rotation of the rotary body.

A clothespin according to a sixth invention is characterized in that in the first invention, further having a hanging portion whose one end being engaged with a pinching portion including the pair of pinching members and the rotary bodies, and having a loop part of such a size as the pinching portion may insert through in the other end.

In the sixth invention, the pinching portion can be engaged easily in such an engaging object location as clothes-rod by the insertion of the pinching portion into the loop part.

A clothespin according to a seventh invention, in either of the first through sixth inventions, the pair of pinching members are provided respectively an inserting piece and a receiving piece, and are pivoted with the inserting piece of one pinching member being inserted into the receiving piece of another pinching member, a stop portion is provided on at least the side of the inserting piece closer to the rotary body or the opposite side, and the stop portion of one pinching member comes into contact with the receiving piece of another pinching member to stop the relative movement, in the direction facing the rotary body of the pivotal portion of the pair of pinching members.

Also, a clothespin according to all eighth invention, in either of the first through sixth inventions, the pair of pinching members are provided respectively an inserting piece and a receiving piece, are pivoted with the inserting piece of one pinching member being inserted into the receiving piece of another pinching member, a stop portion is provided on at least the side of the receiving piece closer to the rotary body or the opposite side, and the stop portion of one pinching member comes into contact with the inserting piece of another pinching member to stop the relative movement, in the direction facing the rotary body of the pivotal portion of the pair of pinching members.

In the seventh invention or the eighth invention, a stop portion is provided on the side of the pivotal position with the inserting piece and the receiving piece, closer to the rotation body and/or on the opposite side thereof with the pivoting position to stop the relative movement, namely, pivotal disengaging, in a direction facing the rotary bodies of the pivoted inserting piece and the receiving piece. For example, the projection-piece shaped stop portion may be provided on the side of the inserting piece closer to the rotary body or the holding portion. The stop portion may be provided on both the sides. Or it may be provided on the side of the receiving piece closer to the rotary body or the holding portion or on both the sides.

A clothes-equipment according to the ninth invention is characterized in having a frame body provided with a hanging portion, and a plurality of clothespin set on the frame body, each of the clothespins having a pair of pinching members pivotally supported in the middle, and to be urged in a direction towards approaching a first side each other by the elastic force, and a rotary body set in the first side of the pinching member for pinching an object, the rotary body having a basic body pivotally supported on the pinching member, and a plurality of blade portions to be projected from the peripheral face of the basic body, and pinching each of the pinching elastic pressure pieces having a basic portion projected from the basic body, and pinching elastic pressure pieces extending into the peripheral direction, having a predetermined angle with respect to the basic portion.

In the ninth invention, as the object can be pinched firmly, and a plurality of clothespins capable of smooth rotation of the rotary bodies in the taking off operation are set on a frame body so that a lot of objects can be pinched within a definite area and the object pinched can be taken off easily for a shorter time.

The above and further objects and features of the invention will more fully be apparent from the following detailed description with accompanying drawings.

DESCRIPTION OF THE PREFERRED EMBODIMENTS

The present invention will be concretely described hereinafter in accordance with drawings showing the embodiments thereof.

Figure 1:
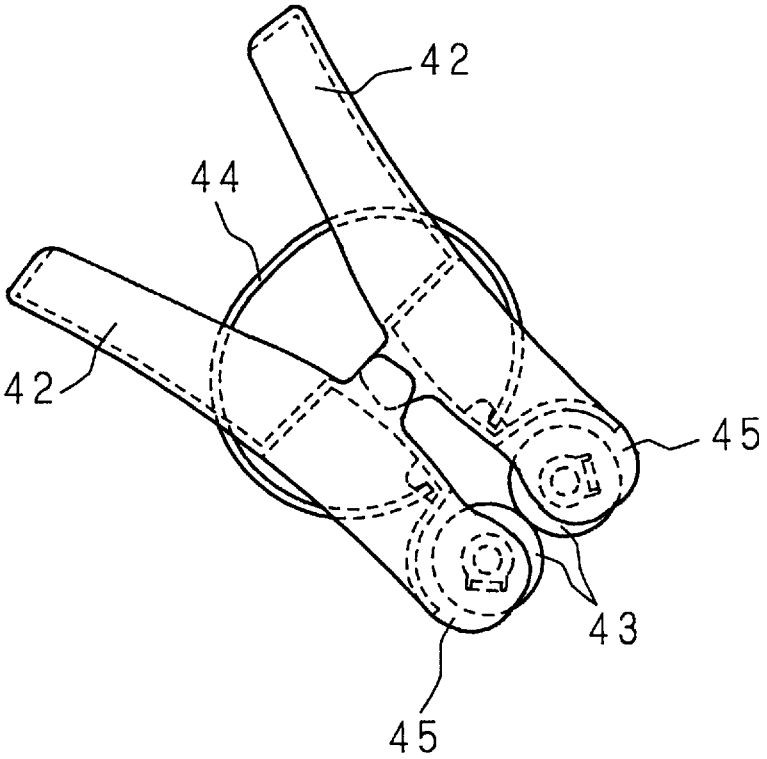
FIG. 1 PRIOR ART
FIG. 1 is an elevation view showing the construction of a conventional clothespin.
Figure 2:
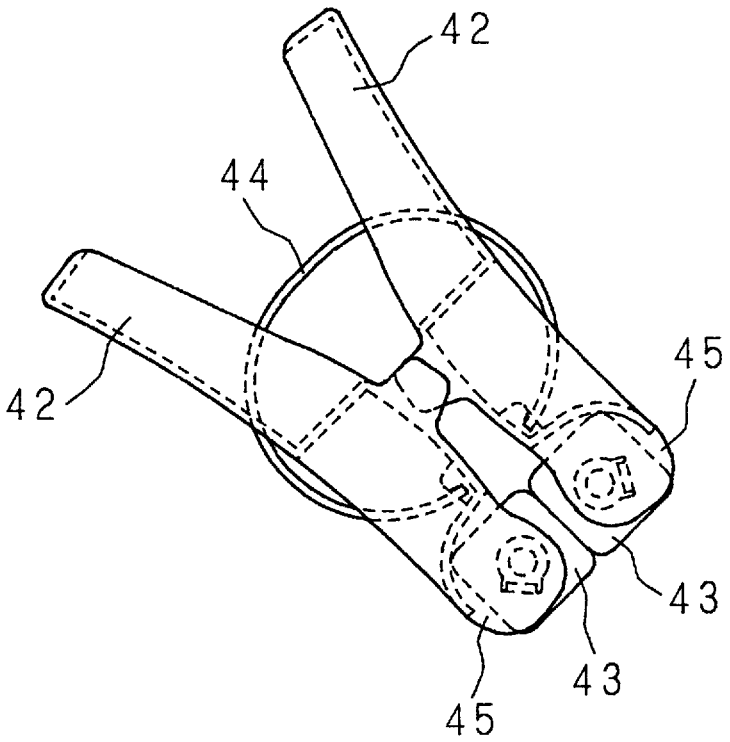
FIG. 2 PRIOR ART
FIG. 2 is an elevation view showing the construction of a conventional clothespin.
Figure 3:
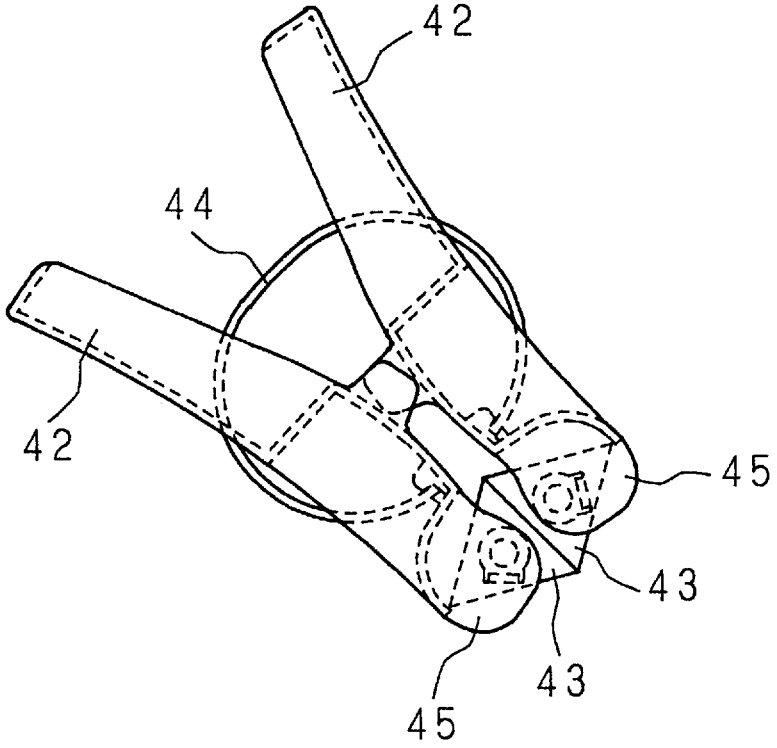
FIG. 3 PRIOR ART
FIG. 3 is an elevation view showing the construction of a conventional clothespin.
Figure 4:
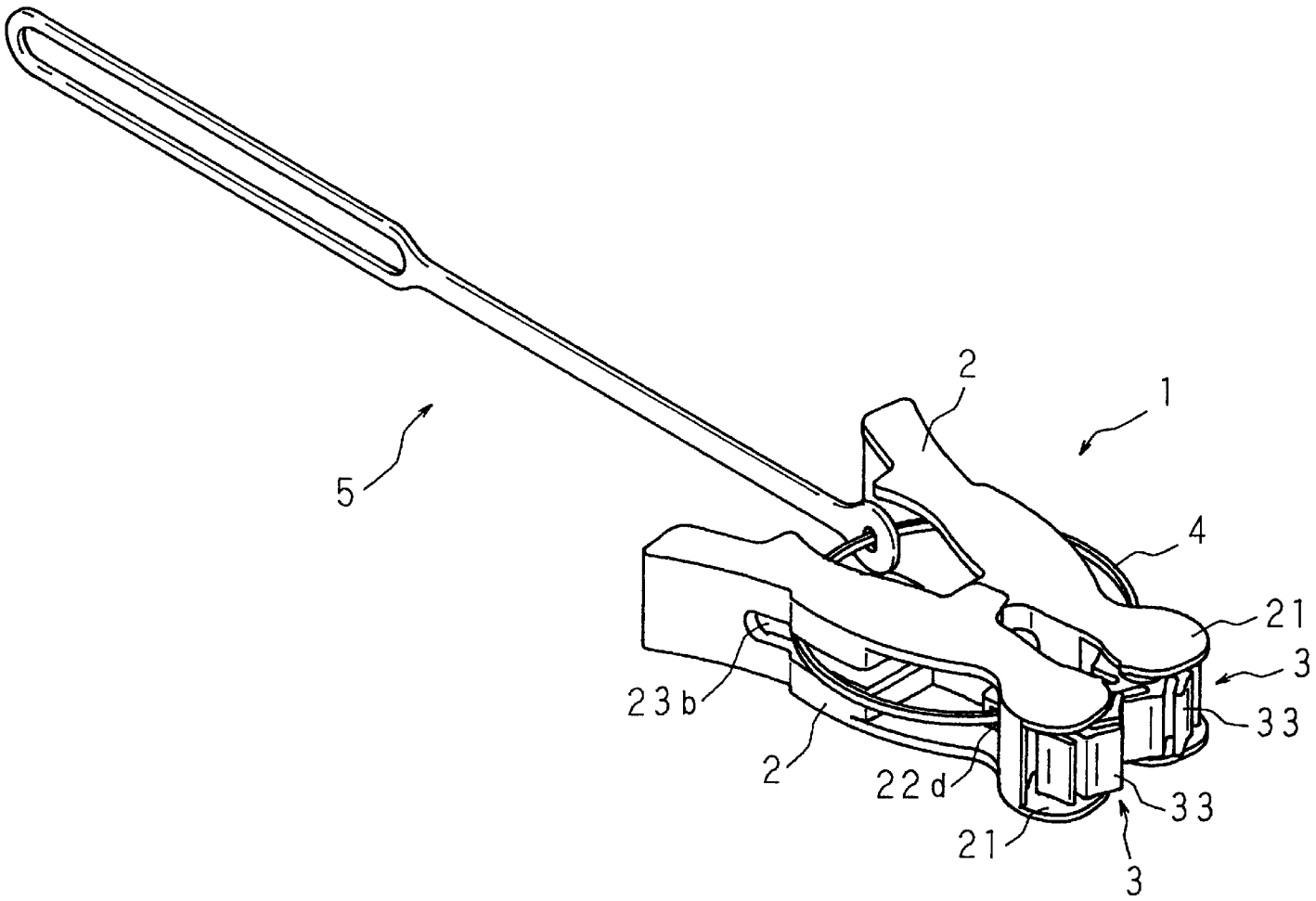
FIG. 4 is a perspective view showing the construction of a clothespin of the present invention.
Figure 5:
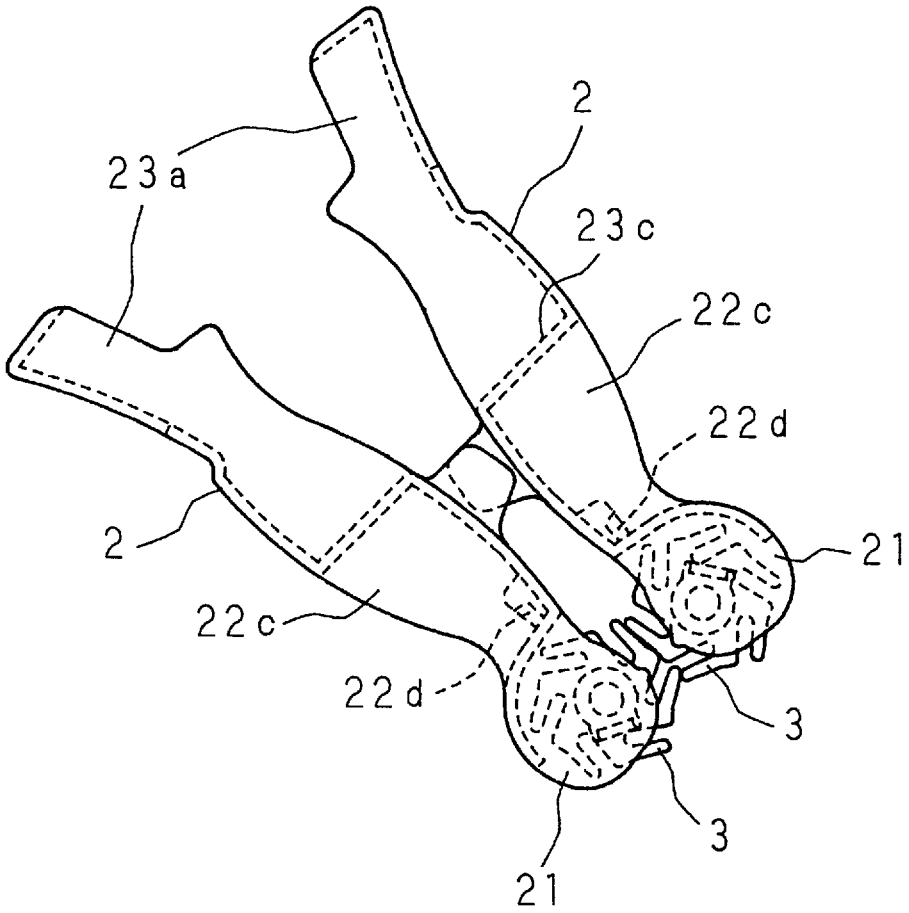
FIG. 5 is an elevation view of FIG. 4.
Figure 6:
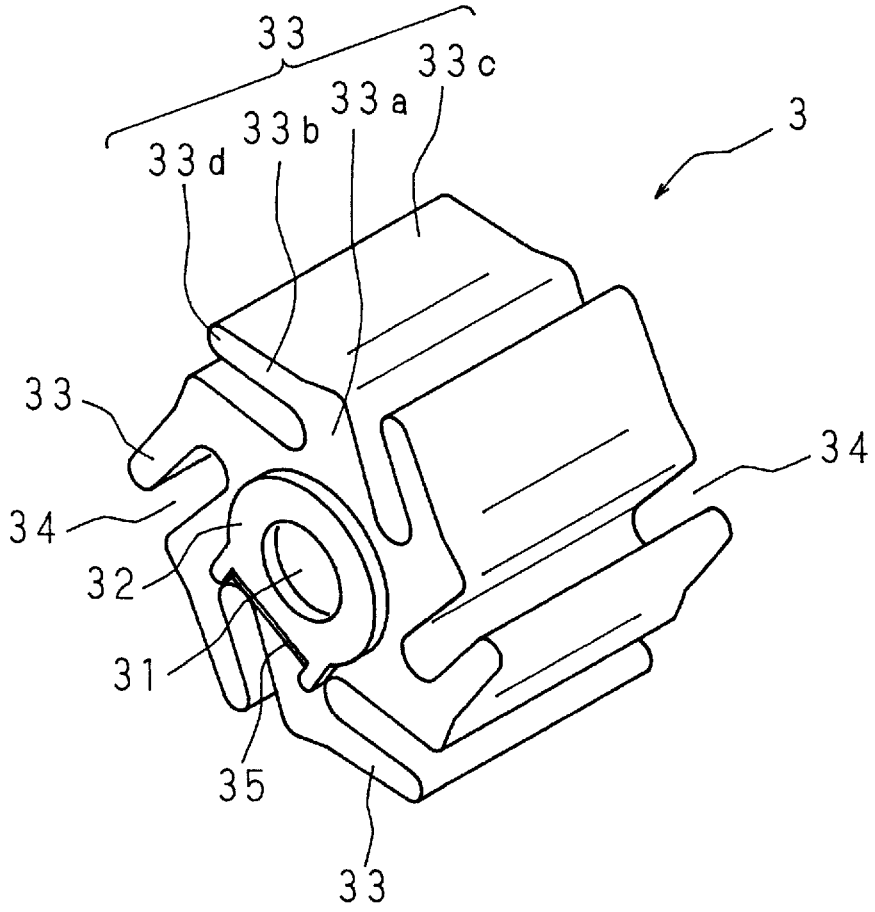
FIG. 6 is a perspective view showing the construction of a rotary body provided with the clothespin of FIG. 4.
Figure 7:
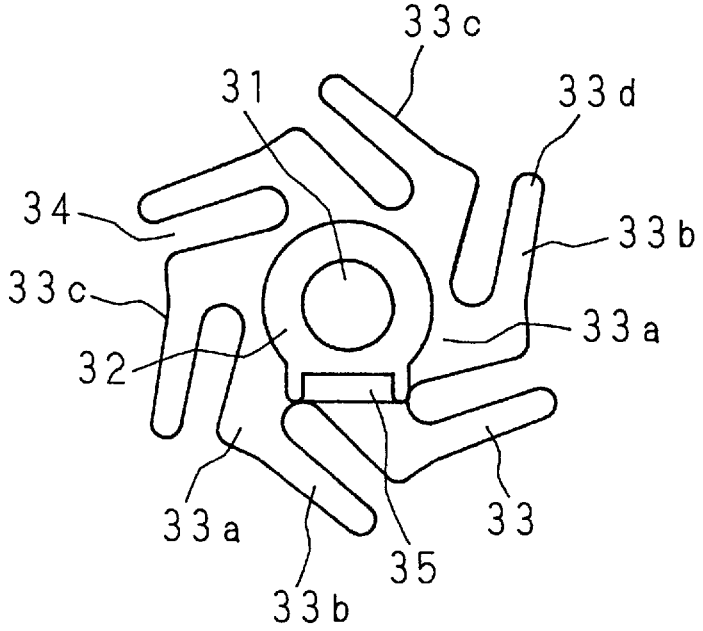
FIG. 7 is all elevation view of FIG. 6.
Figure 8:
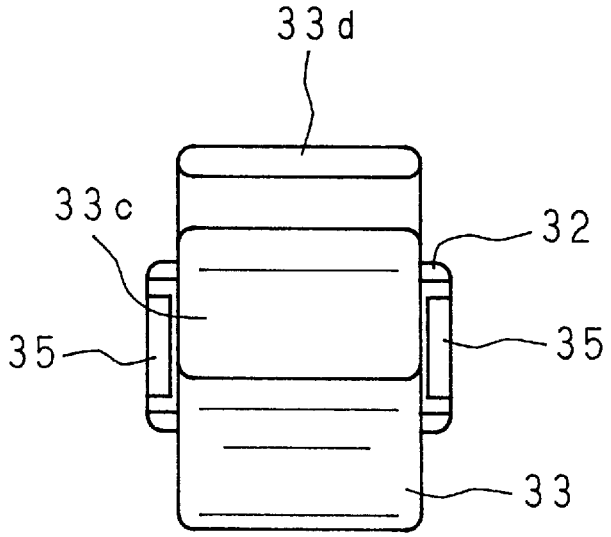
FIG. 8 is a side view of FIG. 6.
Figure 9:
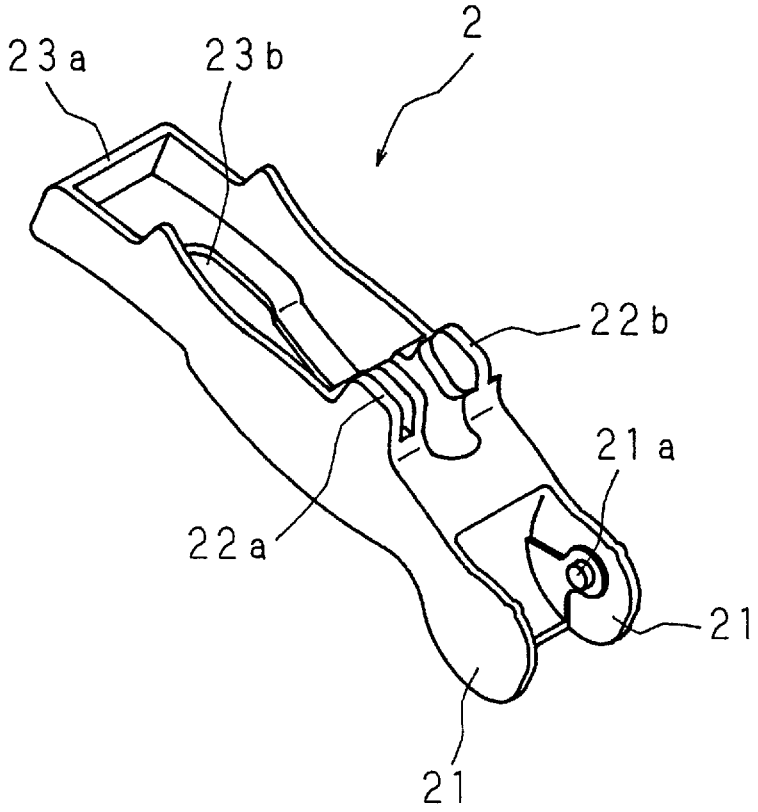
FIG. 9 is a perspective view showing the construction of a pinching member provided with a clothespin of FIG. 4.
Figure 10:
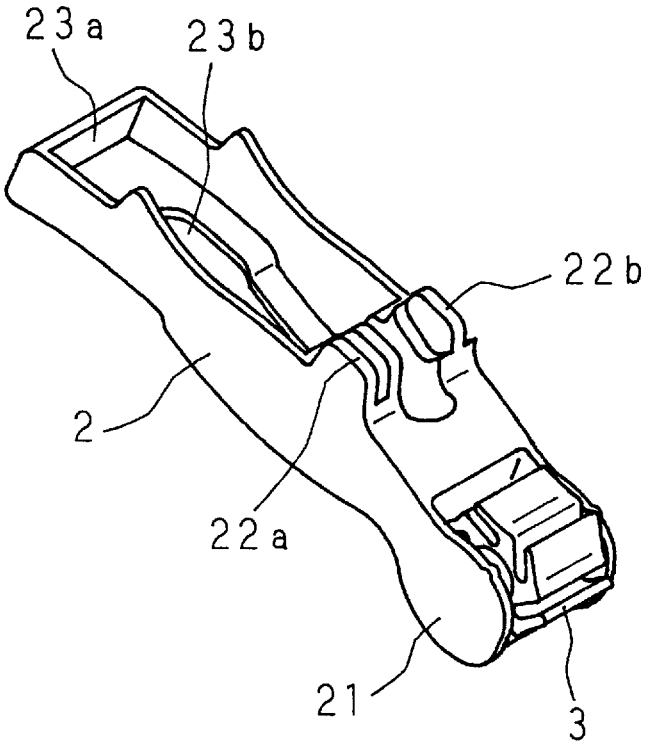
FIG. 10 is a perspective view showing a condition where the rotary body is mounted in the pinching member of FIG. 9.

FIG. 4 is a perspective view showing the construction of a clothespin of the present invention. FIG. 5 is an elevation view of the pin. FIG. 6 is a perspective view showing the construction of a rotary body provided with the clothespin. FIG. 7 is an elevation view thereof. FIG. 8 is a side elevation view thereof. Also, FIG. 9 is a perspective view showing the construction of pinching members provided with the clothespin. FIG. 10 is a perspective view showing a condition where the rotary body is mounted in the pinching member. The clothespin in the embodiment is provided with a pinching portion 1 for pinching and fixing a portion of the washing, and a hanging portion 5 for hanging the washing. The pinching portion 1 is provided with a pair of pinching members 2, 2 in the shape of longitudinally long supported pivotally in the middle, rotary bodies 3, 3 supported pivotally on a first end side of the respective pinching members 2, 2, and a C-type metallic spring 4 for urging ill a direction of respectively approaching the first end sides where the rotary body 3 is provided the respective pinching members 2. The clothespin is made of synthetic resin except for the C-type spring 4.

As shown in FIG. 4, FIG. 5, and FIG. 9, the opposite pinching members 2, 2 are formed integrally with a box-shaped pressing portion 22*c* opened externally on the first end side where the rotary body 3 is mounted, a box-shaped holding portion 23*a* opened internally on a second end side, a coupling portion 23*c* which is a common face and a coupling face of the pressing portion 22*c* and the holding portion 23*a* between them, the shaft Support portions 21, 21 being extended for supporting the rotary body 3 on the front face and the rear face in the end portion of the pressing portion 22*c*. The shafts 21*a*, 21*a* for pivotally supporting the rotary body 3 are projected from the opposite faces of the shaft supporting portions 21, 21.

The box bottom reserve face of the pressing portion 22*c* has first and second joining portions 22*a*, 22*b* provided side by side in the before and behind direction towards the coupling portion 23*c*. The first joining portion 22*a* is a pair of receiving pieces approximately semicircular erected in parallel spaced by a predetermined length in the before and behind direction and the second joining portion 22*b* is a approximately semicircular insertion piece capable of insertion into the gap of the first joining portion 22*a*. Two pinching members 2, 2 are adapted to be pivotally supported through mutual opposing of the first and second joining portions 22*a*, 22*b* and engaging of the insertion piece into the receiving piece. The spring receiving concave portion 22*d* is provided towards the shaft support portion 21 of the box inner bottom of the pressing portion 22*c*. Also, the approximately central portion in the before and behind direction of the pinching member 2 has a long oval shaped space portion 23*b*, along the longthwise direction of the pinching member 2, provided astride the holding portion 23*a*, the coupling portion 23*c* and the pressing portion 22*c*.

As shown in FIG. 6, FIG. 7 and FIG. 8, each rotary body 3 is molded as one body in a gammadion-shape of six blades when seen from the front face. The thickness from the front face to the rear face corresponds to the length between the shaft support portions 21, 21 of the pinching member 2. The rotary body 3 has a blade portion 33, approximately L shape when seen from the front face, projected radially oil the outer periphery of the base body 32 approximately cylindrical in shape, with six blade portions 33, 33 . . . equally spaced in peripheral direction in the present embodiment. The blade portion 33 is provided with a base portion 33*a* closer to the basic body 32, and an elastic pressure pieces 33*b* on the basic portion 33*a*, extending in a peripheral direction having a predetermined angle. The adjacent elastic pressure pieces 33*b*, 33*b* are formed by approximately 120° on the side of the basic body 32, and the elastic pressure piece 33*b* whose outer peripheral face, the pinching face 33*c* being bent externally by a predetermined angle on the side of the tip end portion 33*d*. Also, the elastic pressure piece 33*b* has a tip end longer enough to project externally than the extension line of the pinching face 33*c* having a blade portion 33 on the adjacent side closer to the tip end portion 33*d*. An interlocking space 34 is formed between the elastic pressure piece 33*b* and the basic portion 33*a* of the adjacent blade portion 33.

A bearing hole 31 extending through in the thickness direction is provided in the center of the basic body 32 of the rotary body 3. The bearing hole 31 has a diametrical size corresponding to the shaft 21*a* of the pinching member 2. The basic body 32 is projected slightly from the front face and the rear face from the periphery of the bearing hole 31. On a portion of the external peripheral side, all engaging guide portion 35 is provided in a portion corresponding position in the front face and the rear face of the basic body 32. A taper narrower in the full width is formed in the engaging guide portion 35 with the taper being continuous onto the projection face of the basic body 32 on the internal diameter side and onto the front face or the rear face of the blade portion 33 on the external diameter side.

As shown in FIG. 10, the rotary body 3 of such construction as described above is mounted in the pinching member 2 in a condition where the bearing hole 31 is engaged loosely with a shaft 21*a*. To mount the rotary body 3 into the pinching member 2, the engaging guide portion 35 is brought into contact with the shaft 21*a* and the shaft 21 is slid along the taper for engagement. At this time, the rotary body 3 is supported by the shaft in a direction where the tip end portion 33*d* of the blade portion 33 is confronted with the joining portions 22*a*, 22*b* on the opposite central side of the pinching members 2, 2.

Figure 11:
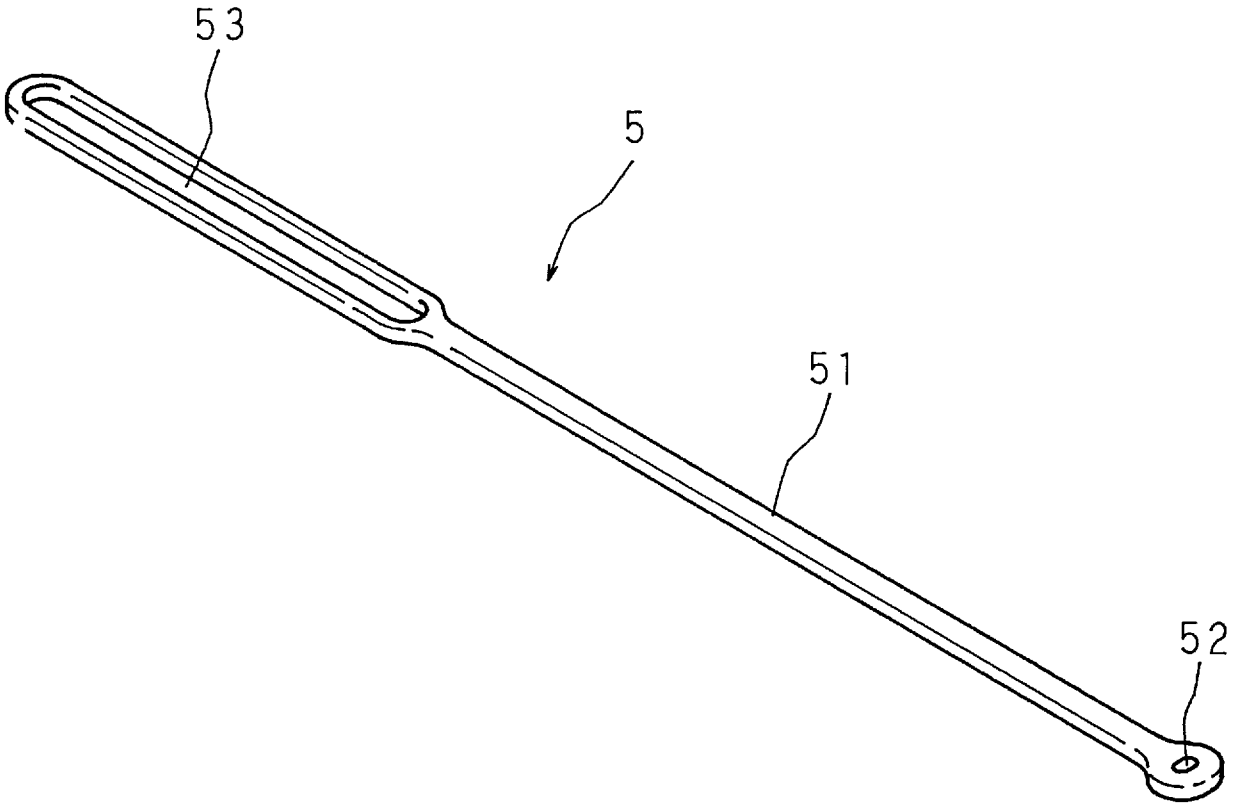
FIG. 11 is a perspective view showing the construction of a hanging portion of the clothespin of the present invention.
Figure 12:
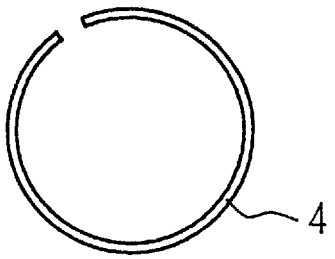
FIG. 12 is an elevation view showing the construction of a C-type spring of the clothespin of the present invention.
Figure 13:
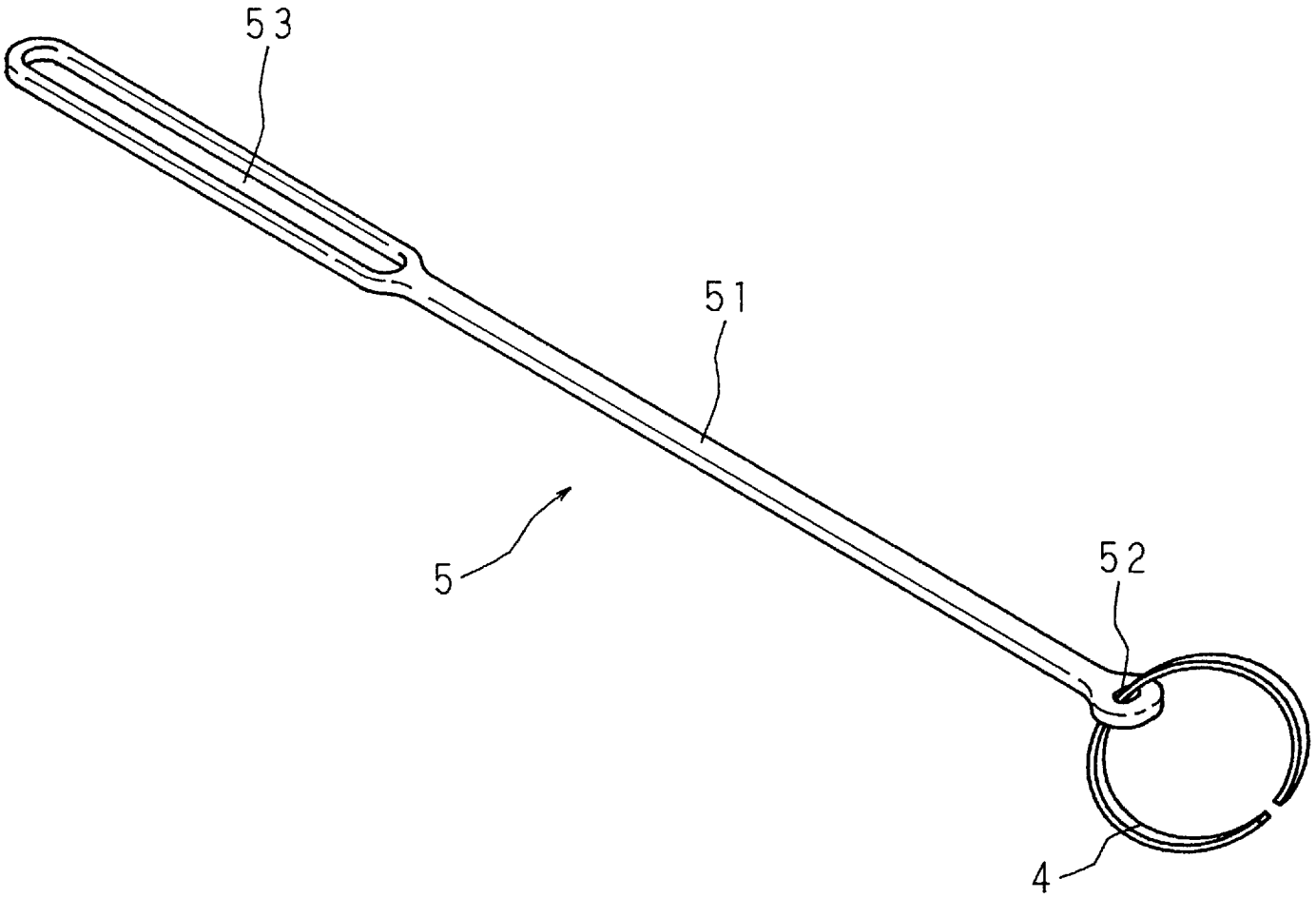
FIG. 13 is a perspective view showing a condition where the C type of spring is set in the hanging portion.

FIG. 11 is a perspective view showing the construction of the hanging portion 5. FIG. 12 is an elevation view showing the construction of the C-type spring 4. FIG. 13 is a perspective view showing a condition where the C-type spring 4 is mounted in the hanging portion 5. As shown in FIG. 11, the hanging portion 5 is integrally molded with a spring through hole 52 through which the C-type spring 4 can be extended loosely in one end of the strap-shaped main body 51, and a long loop portion 53 being long in the lengthwise direction of the hanging portion 5 at the other end. The suspending portion 5, made of synthetic resin, is elastic in material, the loop portion 53 is deformable in shape, and the pinching portion 1 can be inserted in size.

To assemble the clothespin of the present embodiment, both the pinching members 2, 2 with the rotary bodies 3, 3 supported pivotally on them respectively are caused to be pivotally supported each other by the joining portions 22*a*, 22*b* with each other (through joining by the receiving piece and the inserting piece), and both the end portions of the C-type spring 4 are respectively engaged into the spring receiving concave portion 22*d* through the insertion of the C-type spring 4 mounted on the hanging portion 5 into the space portion 23*b* as shown in FIG. 13. The pressing portion of the pinching portion 1 is urged by the C-type spring 4 towards its approaching direction. As described hereinabove, the pinching portion 1 is suspended in a hanging object location by the engagement with the hanging portion 5.

Figure 14:
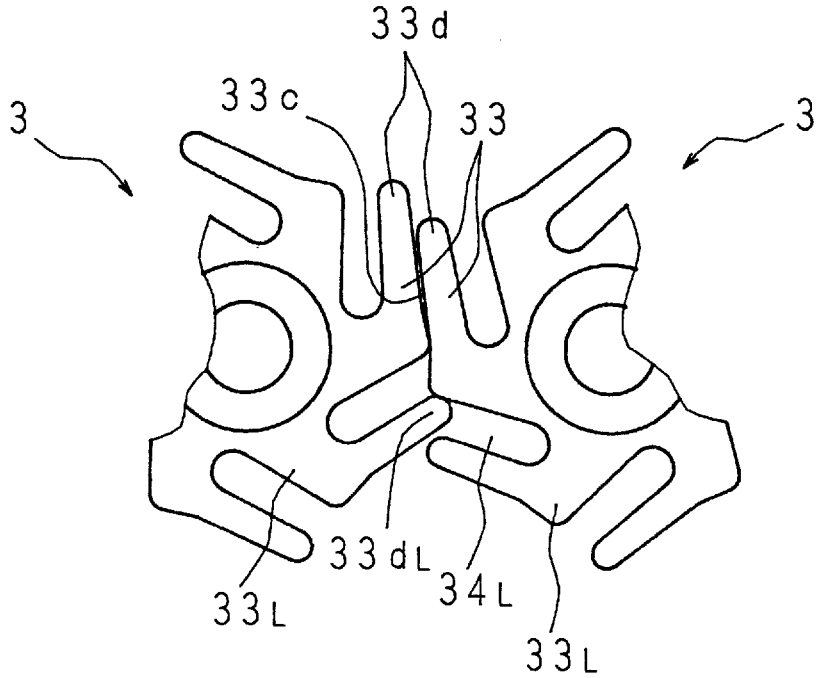
FIG. 14 is an elevation view showing the positional relation and the rotating condition of the rotary body.
Figure 15:
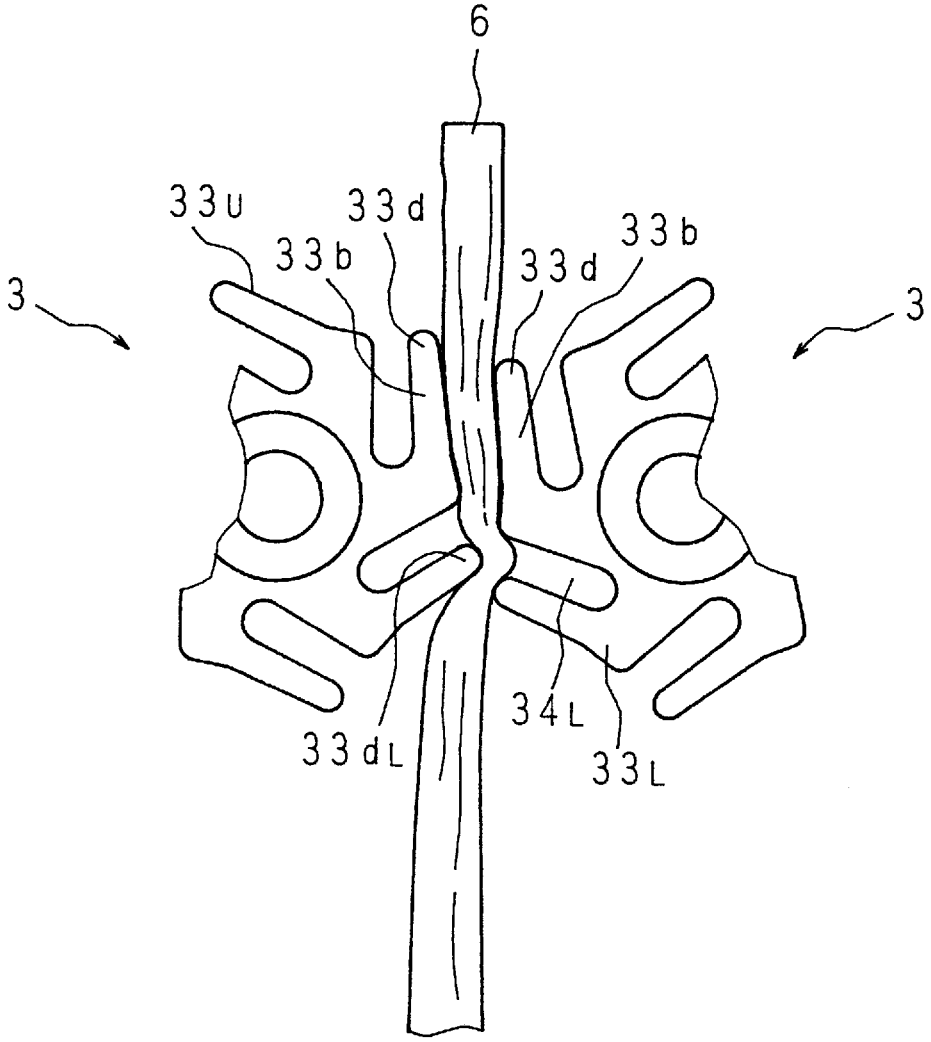
FIG. 15 is an elevation view showing the positional relation and another rotating condition of the rotary body.
Figure 16:
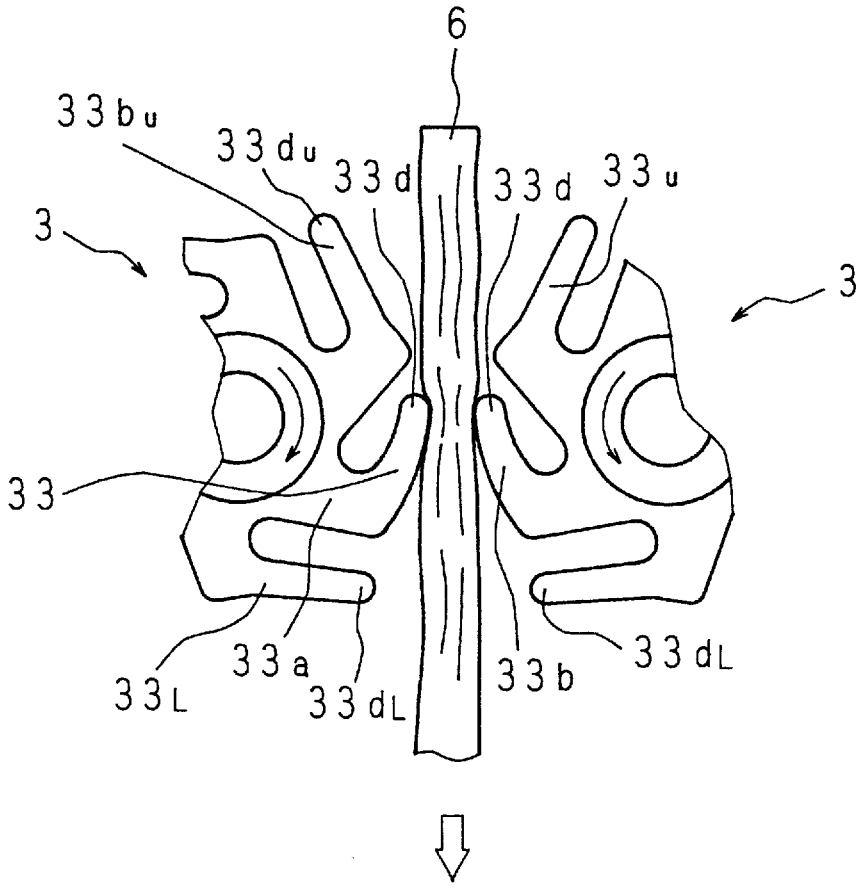
FIG. 16 is an elevation view showing the positional relation and another rotating condition of the rotary body.

A condition where the washing is pinched by such a clothespin constructed as described above and the rotary body 3 is rotated in taking off the washing will be described hereinafter. FIG. 14 through FIG. 16 are elevation views showing the positional relationship and rotating condition of the rotary bodies 3, 3, showing only the rotary body 3. FIG. 14 shows a condition of a rotary body 3 where the washing is not pinched. FIG. 15 and FIG. 16 show a condition of the rotary body 3 in taking off the washing pinched by the pinching member 2. In both the cases, the vertical direction in a condition where the pinching portion 1 is suspended is a vertical direction on the drawing. In a condition where the washing is not pinched, as shown in FIG. 14, the rotary bodies 3, 3 have the pinching faces 33*c*, 33*c* in contact with each other in a different rotating phase, namely, in an embodiment where the tip end portion 33*d* of the opposite blade portion 33 is shifted in vertical direction. Blade portions $\mathbf{33}_L$, $\mathbf{33}_L$ in the lower stage of the blade portion 33 to come into contact with each other shifts the tip end portion $\mathbf{33}d_L$ likewise in the vertical direction with the tip end portion $\mathbf{33}d_L$ of the rotary body 3 on the left side (or the right side) shifted onto the upper side being in contact with the open portion of the interlocking space $\mathbf{34}_L$ of the rotary body 3 of the right side (or the left side).

When the washing 6 is pinched by the pressing portion, the washing 6 is depressed from both sides by the elastic pressure piece 33*b* of the opposite blade portion 33 as shown in FIG. 15. As the tip end portions 33*d*, 33*d* of the elastic pressure pieces 33*b*, 33*b* are bent onto the opposite sides with each other, the washing 6 is firmly pinched to prevent the washing 6 from falling off. Also, the tip end portions $\mathbf{33}d_L$, $\mathbf{33}d_L$ of the $\mathbf{33}_L$, $\mathbf{33}_L$ in the lower stage of the blade portions 33, 33 are shifted vertically in the position to pinch the washing 6. Especially, the tip end portion $\mathbf{33}d_L$ on the left side (or the right side) shifted onto the upper side to thrust the washing 6 into the interlocking space $\mathbf{34}_L$ on the right side (or the left side) to prevent the washing from coming off.

When the washing 6 has been pulled downwards, the rotary object 3 on the left side is rotated clockwise and the rotary body 3 on the right side is rotated counter-clockwise to send the washing 6 downwards. The tip end portion $\mathbf{33}d_L$ of the blade portion $\mathbf{33}_L$ in the lower stage shown in FIG. 15 leaves the washing 6 and then, the basic end side of the elastic pressure piece 33*b* pinching the washing 6 leaves to pinch the washing 6 only with the tip end portion 33*d*. At this time, the tip end portion 33*d* is bent towards the side of the bearing hole 31 by the elastic force of the elastic pressure piece 33*b* and the elastic pressure piece 33*b* become approximately a circular arc in shape. Thus, the rotation of the rotary body 3 becomes smoother, namely, the delivery of the washing 6 become smoother. Further, the rotary body 3 rotates and blade portions $\mathbf{33}_u$, $\mathbf{33}_u$ in the upper stage pinches the washing immediately before the tip end portion 33*d* leaves the washing 6. The washing 6 is pinched again by the blade portions $\mathbf{33}_u$, $\mathbf{33}_u$. At this time, the blades portions $\mathbf{33}_u$, $\mathbf{33}_u$ pinch the washing 6 on the side upper than the central line connecting the axial center of the rotary bodies 3, 3 so that force in a direction of preventing the rotation is given to the rotary body 3. Thereafter, when the downward force is operated continuously on the washing, the tip end portion 33*d* of the blade portion 33 which comes to a lower stage next leaves the washing 6. The rotating operation of the above described rotary body 3 is repeated to deliver the washing 6 onto the lower side.

In this manner, when the tip end port ion 33*d* pinches the washing 6 on the side upper than the center of the rotary body 3, the rotary body 3 firmly pinches the washing 6 from both the sides by the pinching face 33*c*. When the tip end portion 33*d* is in a position where the washing 6 is pinched on the side lower than the center of the rotary body 3 during the rotation of the rotary body 3, the elastic pressing piece 33*b* is deformed into the shape of approximately circular arc, and the rotation of the rotary body 3 becomes soother. By the rotation of the rotary body 3, a plurality of blade portions 33, 33 repeat the operation, namely, deforming for rotation and pinching by the pinching face, in order, the rotating force corresponding to the amount of pulling the washing 6 is given to delivery the washing 6 by a length corresponding to the rotating force.

Figure 17:
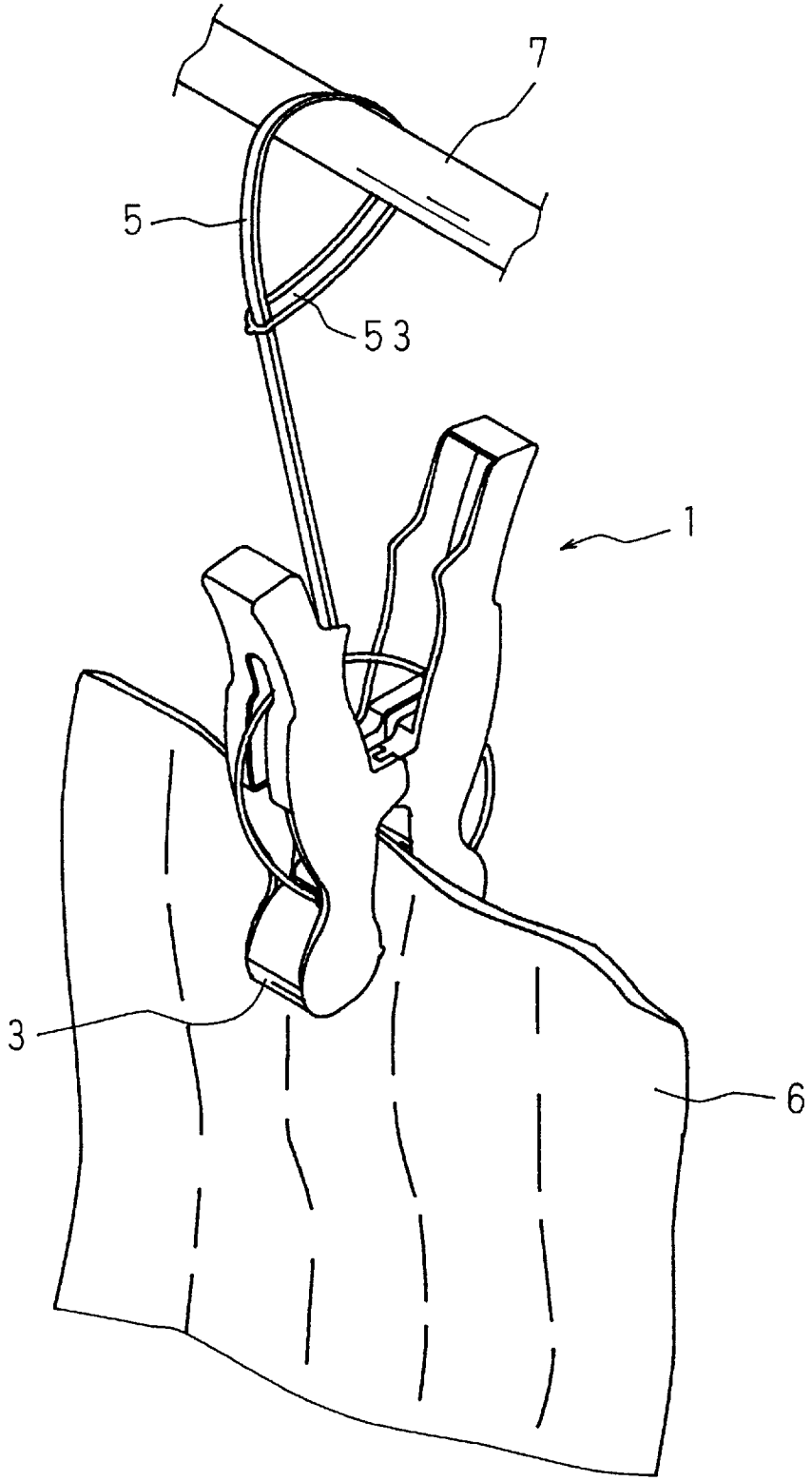
FIG. 17 is a perspective view showing the using condition of the clothespin of the present invention.

FIG. 17 is a perspective view showing the using condition of the clothespin constructed as described above. As shown in FIG. 17, a strap-shaped main body 51 of the hanging portion 5 is hanged on the clothes-rod 7. The pinching portion 1 is inserted through the loop portion 53 to engage the hanging portion 5 with the clothes-rod 7. The washing is dried with being pinched at the pressing portion. In order to take in the washing, pull the washing 6 and the rotary body 3 is rotated so that the washing 6 can be smoothly taken off from the clothespin without damaging as described above. In this manner, in the clothespin in the embodiment of the present invention, the washing 6 can be pinched firmly, and the washing 6 can be smoothly taken off by the smoother rotation of the rotary body 3. Also, as the rotary body 3 is rotated by the rotating force corresponding to the amount of pulling the washing 6, reluctant dropping is not caused through the rotation of the rotary body 3 by the small pulling force caused with pulling by the collision between the washing and other or the like during the drying operation. Furthermore, the pinching portion 1 can be suspended on the clothes-rod 7 by the direct engaging of the loop portion 53 of the hanging portion 5 onto the clothes-rod 7.

Figure 18:
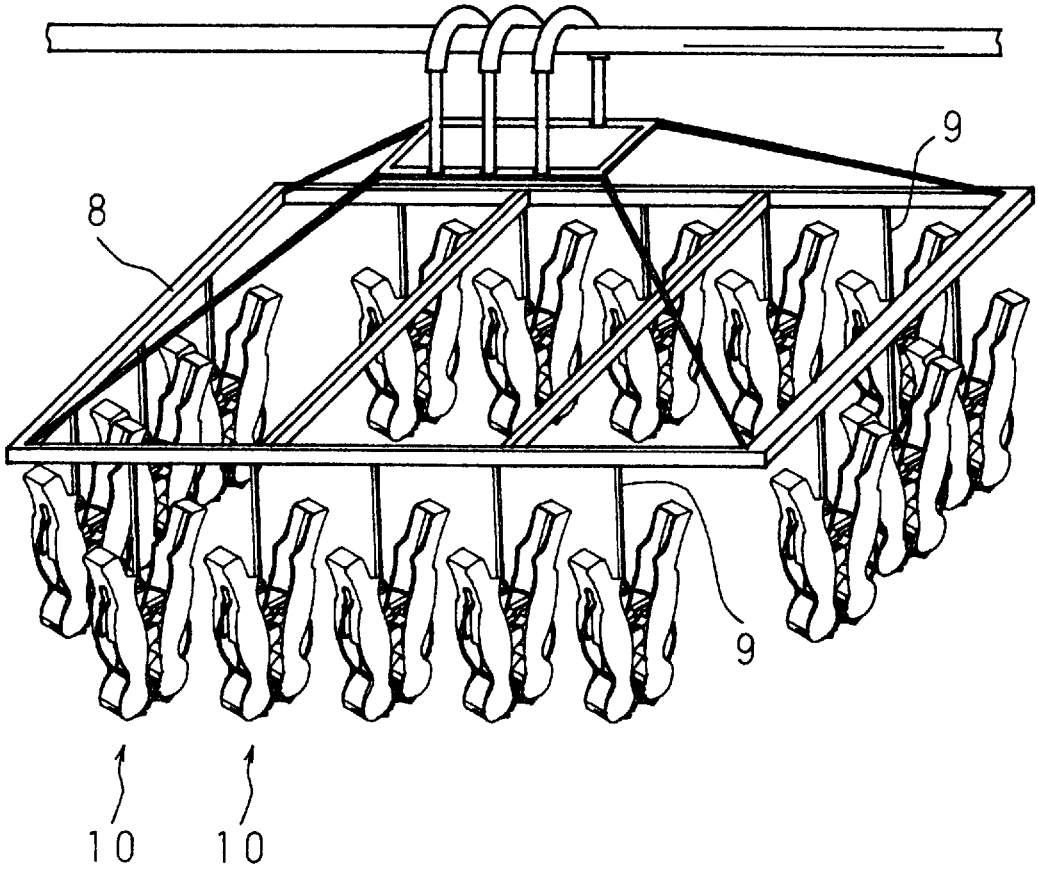
FIG. 18 is a perspective view showing the construction of the clothes-equipment using the clothespin of the present invention.

Also, FIG. 18 is a perspective view showing the construction of a clothes-equipment using the clothespin of the present invention. The clothes-equipment shown in FIG. 18 is construction with a plurality of clothespins 10, 10 . . . being suspended side by side on the hanging frame 8 so that many washing can be dried within a definite area. As the clothespin 10 is similar as the clothespin 10 shown in FIG. 4 with the exception of the different construction in that the hanging portion 9 where the hanging portion is fit with the suspending frame 8. It is to be noted that the corresponding parts are designated by the same numerals to omit the description thereof. The washing (not shown) is pinched with the clothespin 10, 10 . . . and then, is dried. The washing is taken off from the clothespin 10 through the rotation of the rotary bodies 3, 3 by the pulling of the washing. Similar effects as those in the above described embodiment can be obtained by such clothes-equipment as described hereinabove.

Figure 19:
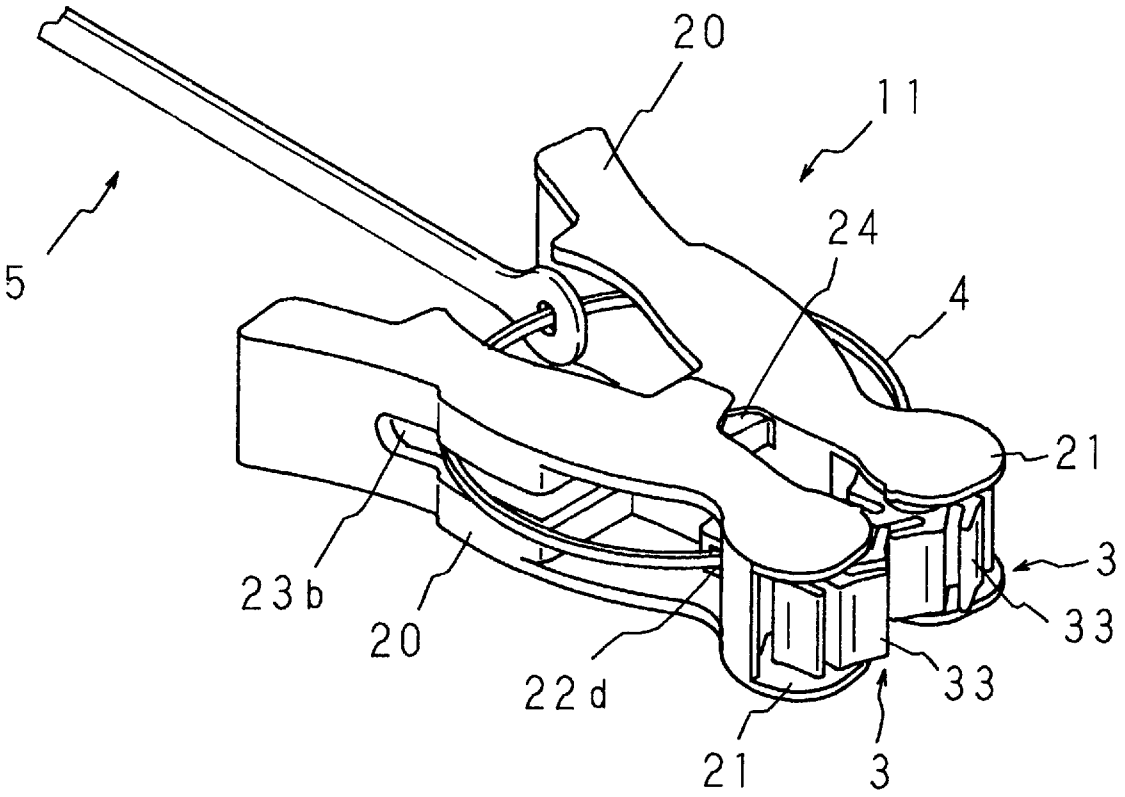
FIG. 19 is a perspective view showing the construction of another clothespin according to the present invention.

Furthermore, such a clothespin shown in FIG. 4 as described above is pivotally supported at the approximate center of the pinching portion 1 with a second joining portion 22*b* as an inserting piece being inserted into a first joining portion 22*a* as a receiving piece. In the pivoting portion, the projecting piece is inserted into the groove. The opposite pinching members 2, 2 are movable to slip in a direction the projection piece moves along the groove, namely, in the longthwise direction of the pinching member 2. When the washing 6 has been pulled with force in the directions different from the direction of disengaging the washing in taking in the washing 6 pinched by the clothespin as shown in, for example, FIG. 17, the pivoting portion may be disengaged because of the vertical sliding in the opposite positions of the rotary bodies 3, 3. FIG. 19 is a perspective view of the clothespin capable of preventing the disengagement between the pivoting portions.

Figure 20:
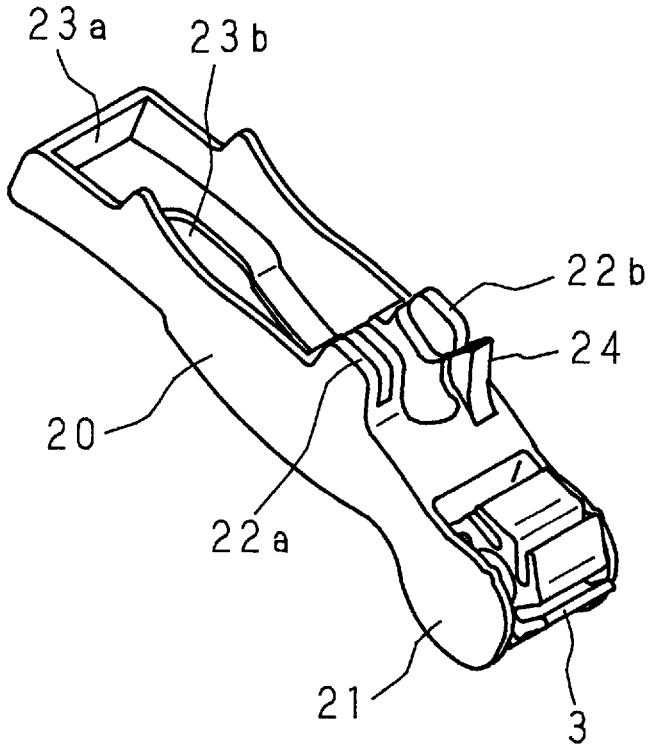
FIG. 20 is a perspective view showing the construction of the pinching member and the rotary body provided with the clothespin of FIG. 19.

As shown in FIG. 19, the pinching portion 11 is composed of a pair of pinching members 20, 20 to be pivoted at the approximate center, rotary bodies 3, 3 pivoted at the first end side on the respective pinching member 20, and a C-type spring 4 urged towards a direction of approaching the sides each other on which the rotary body 3 of the pinching member 20 is provided. FIG. 20 is a perspective view showing the construction of one of a pair of pinching members 20. The pinching members 20 same in construction are adapted to be pivoted as a pair.

The first joining portion 22*a* and the second joining portion 22*b* are arranged in parallel relation in the before and behind direction at the approximate center on the opposite sides of the pinching members 20 as shown in FIG. 19 and FIG. 20. An approximate triangle-piece shaped stop portion 24 to be projected onto the opposite side from the box bottom reverse face of the pinching member 20 is provided on the side close to the rotary body 3 of the second joining portion 22*b*. The stop portion 24 has the projection height approximately same as that of the second joining portion 22*b*, and is shaped along the side face facing the rotary body 3 of the first joining portion 22*a* of the opposite pinching member 20. The other construction is same as that of the clothespin shown in FIG. 4 with the corresponding parts being designated by the same reference numerals. The description thereof is omitted.

Figure 21:
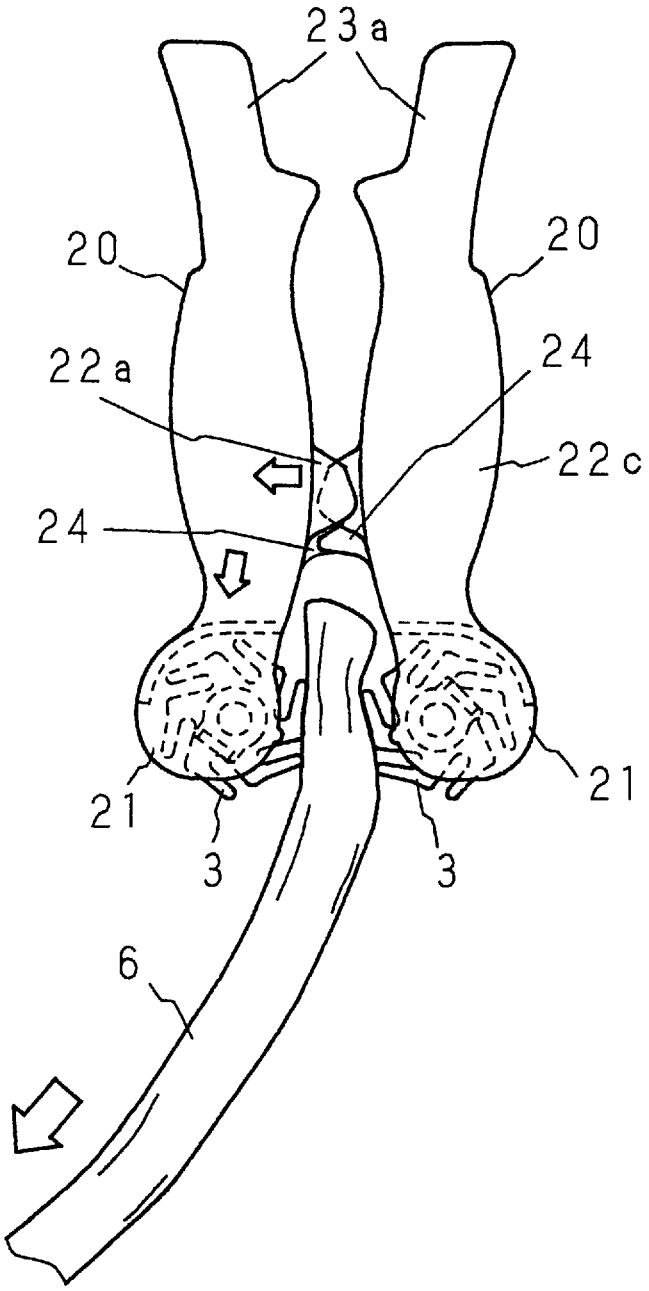
FIG. 21 is a perspective view showing the using Condition of the clothespin of FIG. 19.

FIG. 21 is a view for explaining the condition where the washing 6 pinched in the clothespin of such construction is disengaged from. The rotary bodies 3, 3 are rotated through the downward pulling of the washing 6 without the operation of the holding portions 23*a* of the clothespin. As the operation for the washing 6 to be pulled out by the rotation thereof, and the effects are same as described in FIG. 4, the description thereof is omitted. The force to the left direction (or right direction) and the downward force are added to the left-hand (or right-hand) pinching member 20 so that the engaging size between the first and second joining portions 22*a* and 22*b* may become shallower when the washing 6 has been pulled with force in the left direction (or right direction), not in the downward direction. At this time, the stop portion 24 of the right-hand (or left-hand) pinching member 22 is projected onto the side a closer to the first joining portion 22*a* of the left-hand (or right-hand) pinching member 20, and comes into contact with the left-hand first joining portion 22*a* to prevent the downward movement. Also, the upward movement of the left-hand (right-hand) pinching member 20 is prevented, because the stop portion 24 provided with the left-hand (or right-hand) pinching member 20 comes into contact with the second joining portion 22*b* of the right-hand (or left-hand) pinching member 20.

The stop portions 24, 24 provided in the pinching members 20, 20 in this manner can prevent the disengagement of the pivotal portion which may be caused in the pulling of the washing 6.

Figure 22:
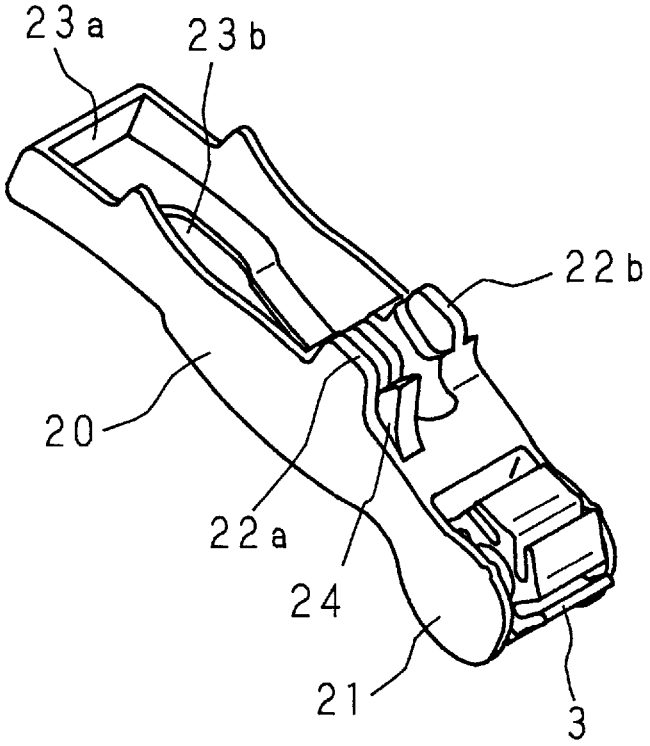
FIG. 22 is a perspective view showing the construction of the pinching member and the rotary body provided with a still another clothespin of the present invention.

The stop portion 21 of such construction as described above is not restricted to the above description although the stop portion 24 provided on the side closer to the rotary body 3 of the second joining portion 22*b* is explained. As shown in, for example, FIG. 22, the same effects can be obtained even when it is provided on the side closer to the rotary body 3 of the first joining portion 22*b*. FIG. 22 is a perspective view showing the construction of one of the pair of pinching members 20. In this case, the stop portion 24, same in the shape as that of FIG. 20, has shape along the side face facing the rotary body 3 of the second joining portion 22*b* of the opposite pinching member 20 in a condition where the pinching members 20, 20 are pivoted.

Figure 23:
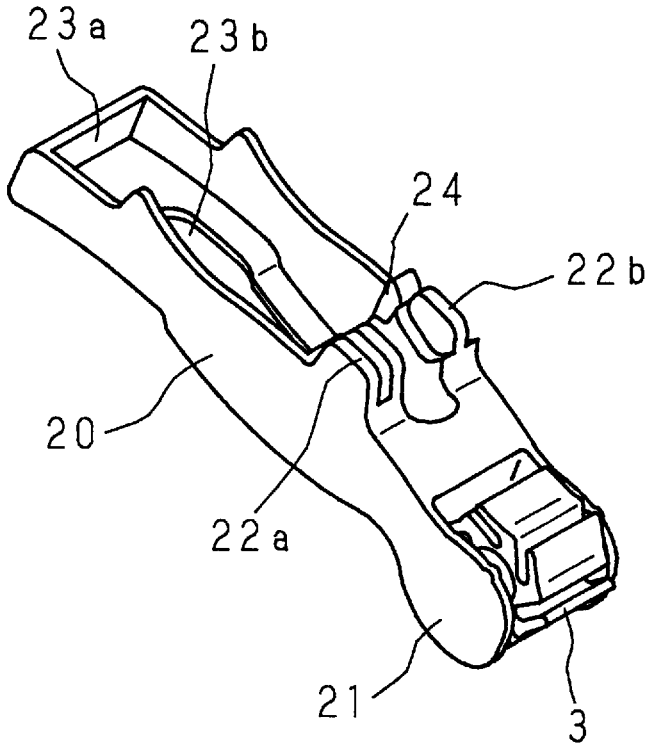
FIG. 23 is a perspective view showing the construction of the pinching member and the rotary body provided with a further clothespin of the present invention.
Figure 24:
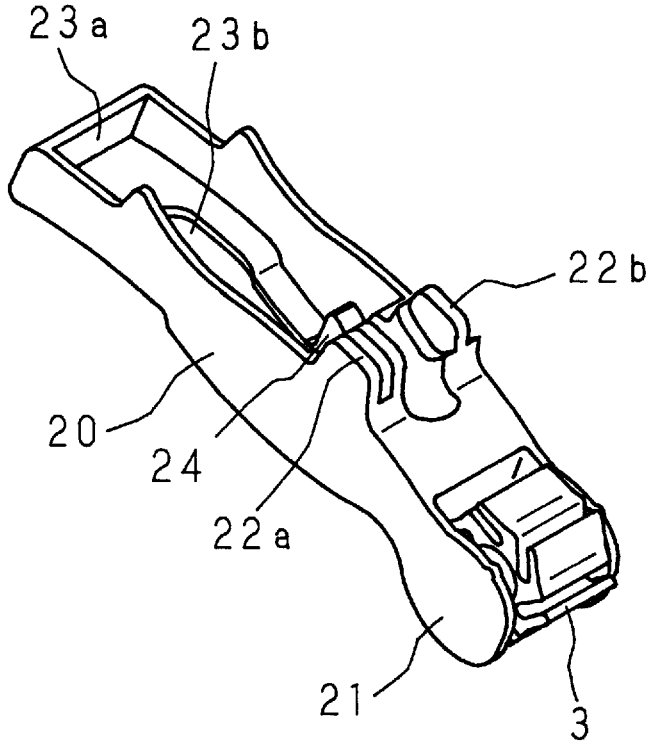
FIG. 24 is a perspective view showing the construction of the pinching member and the rotary body provided with a still further clothespin of the present invention.

Also, as shown in FIG. 23, the stop portion 24 may be formed on the side closer to the holding portion 23*a* of the second joining portion 22*b*. The same effects can be obtained even when it is provided on the side closer to the holding portion 23*a* of the first joining portion 22*a* as shown In FIG. 24. FIG. 23 and FIG. 24 are respectively perspective views showing the construction of one of the pinching members 20 which are formed into a pair. In this case, the stop portion 24 is same in shape as that of FIG. 20 and FIG. 19. But the stop portion 24 has shape along a side face facing the holding portion 23*a* of the opposite joining portion in a condition where the pinching members 20, 20 are pivoted.

Further, the stop portion 24 may be formed respectively on both the sides closer to the rotary body 3 of the first joining portion 22*a* and the side closer to the holding portion 23*a*. Further, the same effects can be obtained even when the stop portion 24 is formed on both the sides, the side closer to the rotary body 3 of the second joining portion 22*b* and the side closer to the holding portion 23*a*.

Although the clothes-pin in the above described embodiment has been described by way of a case where the rotary body has a six-blade portion, the clothespin is not restricted to the above described clothespin. The blade portion, if it has a plurality of blades, will do.

As described hereinabove, in the present invention, the rotary body pivoted on the pinching member has a plurality of blade portions, the object call be firmly pinched by the elastic force of the pinching elastic pressing piece of the blade portion, making it possible to smoothly rotate the rotary body in taking off operation thereof. Also, the tip end of the blade portion is bent externally so that the pinching operation of the object can be further strengthened. Further, as the lower stage of the blade portion for pinching the object pinches the object with the tip end, the pinching operation of the object can be further improved. The clothespin can be easily engaged with, for example, the clothes-rod by the insertion of the pinching operation through the loop portion provided in one end of the hanging portion. A lot of objects call be pinched in a definite area by fit with such clothespin on the frame, with effects so that the taking-in operation can be effected smoothly in a shorter time.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A clothespin comprising:

a pair of pinching members pivotally supported in the middle, each of the pinching members having a first side and a second side, for urging in a direction mutually approaching the first sides by an elastic force; and a rotary body set in the first side of the pinching members to pinch the object, wherein the rotary body includes:

a basic body pivotally supported on the pinching member; and a plurality of blade portions projected from the peripheral face of the basic body, each having a basic portion projected from the basic body, and pinching elastic pressure pieces extending into the peripheral direction having a predetermined angle with respect to the basic portion.

2. The clothespin according to the claim 1, wherein adjacent pinching elastic pressure pieces of the rotary body have an angle of 120°±10° with the side closer to the basic body.

3. The clothespin according to the claim 1, wherein each of the pinching elastic pressure pieces bends a tip end of an externally peripheral face to the outside.

4. The clothespin according to the claim 1, wherein each of the pinching elastic pressure pieces is extended beyond an extended line of the adjacent pinching elastic pressure pieces, closer to the basic portion.

5. The clothespin according to the claim 1, further comprising a hanging portion with one end being engaged with a pinching portion including the pair of pinching members and the rotary bodies, and having a loop part of such a size as the pinching portion may insert through in the other end.

6. The clothespin according to the claim 2, wherein each of the pinching elastic pressure pieces is extended beyond an extended line of the adjacent pinching elastic pressure pieces closer to the basic portion.

7. The clothespin according to the claim 3, wherein each of the pinching elastic pressure pieces is extended beyond an extended line of the adjacent pinching elastic pressure pieces closer to the basic portion.

8. The clothespin according to the claim 3, wherein the rotary bodies pivotally supported on the pinching members have a different rotating phase to oppose against the corresponding pinching elastic pressure pieces.

9. The clothespin according to the claim 8, wherein each of the pinching elastic pressure pieces is extended beyond an extended line of the adjacent pinching elastic pressure pieces closer to the basic portion.

10. The clothespin described according to claim 1, wherein the pair of pinching members are provided respectively with an inserting piece and a receiving piece and are pivoted with the inserting piece of one pinching member being inserted into the receiving piece of another pinching member, a stop portion is provided on at least the side of the inserting piece closer to the rotary body or the opposite side, and the stop portion of one pinching member comes into contact with the receiving piece of another pinching member to stop the relative movement, in the direction for the rotary body, of the pivotal portion of the pair of pinching members.

11. The clothespin described according to claim 1, wherein the pair of pinching members are provided respectively with an inserting piece and a receiving piece and are pivoted with the inserting piece of one pinching member being inserted into the receiving piece of another pinching member, a stop portion is provided on at least the side of the receiving piece closer to the rotary body or the opposite side, and the stop portion of one pinching member comes into contact with the inserting piece of another pinching member to stop the relative movement, in the direction for the rotary body, of the pivotal portion of the pair of pinching members.

12. A clothes equipment comprising:

a frame body provided with a hanging portion; and a plurality of clothespin set on the frame body, wherein each of the clothespins includes:

a pair of pinching members pivotally supported in the middle, each of the pinching members having a first side and a second side, for urging in a direction mutually approaching the first sides by an elastic force; and a rotary body set in the first side of the pinching member to pinch an object, the rotary body having a basic body pivotally supported on the pinching member, and a plurality of blade portions projected from the peripheral face of the basic body, each having a basic portion projected from the basic body, and pinching elastic pressure pieces extending into the peripheral direction having a predetermined angle with respect to the basic portion.

* * * * *